United States Patent [19]

Naganuma et al.

[11] Patent Number: 4,721,050

[45] Date of Patent: Jan. 26, 1988

[54] FEED DEVICE FOR A SEWING MACHINE

[75] Inventors: Nobuyuki Naganuma; Fujio Horie; Kenji Matsubara, all of Nagoya, Japan

[73] Assignee: Brother Kogyo Kabushiki Kaisha, Nagoya, Japan

[21] Appl. No.: 931,853

[22] Filed: Nov. 18, 1986

[30] Foreign Application Priority Data

Nov. 20, 1985 [JP] Japan ..... 60-260441

[51] Int. Cl.[4] ..... D05B 27/14; D05B 27/22

[52] U.S. Cl. ..... 112/315; 112/318

[58] Field of Search ..... 112/303, 314, 315, 318, 112/322

[56] References Cited

U.S. PATENT DOCUMENTS

| | | | |
|---|---|---|---|
| 4,286,532 | 9/1981 | Tonomura | 112/314 |
| 4,295,435 | 10/1981 | Uemura et al. | 112/322 |
| 4,318,360 | 3/1982 | Uemura et al. | 112/318 |
| 4,616,583 | 10/1986 | Takano et al. | 112/314 X |

FOREIGN PATENT DOCUMENTS

| | | | |
|---|---|---|---|
| 2927869 | 1/1980 | Fed. Rep. of Germany | 112/322 |
| 59-59952 | 4/1984 | Japan | 112/322 |
| 59-149178 | 8/1984 | Japan | 112/322 |

*Primary Examiner*—Wm. Carter Reynolds

*Attorney, Agent, or Firm*—Barnes & Thornburg

[57] ABSTRACT

A feed device has feed members for feeding a work, and a stepping motor for directly driving the feed members. The period of driving pulses for driving the stepping motor is determined by feed control means on the basis of a speed signal indicating an actual operating speed of the main motor of the sewing machine or on the basis of a selectively set speed. The feed control means controls the stepping motor so that the feed motion of the feed members is continued also after the completion of the thread tightening operation of the take-up lever in order that the needle thread is tightened properly by the feed motion of the feed members.

12 Claims, 9 Drawing Figures

FEED DEVICE FOR A SEWING MACHINE

BACKGROUND OF THE INVENTION

The present invention relates to a feed device for an electronically controlled pattern sewing machine and, more specifically, to a feed device which is driven directly by a stepping motor.

In the conventional electronically controlled pattern sewing machine, in general, the needle bar reciprocating mechanism and the vertical feed dog driving mechanism are driven by the main motor of the sewing machine, while the needle bar swinging mechanism and the horizontal feed dog driving mechanism are driven by stepping motors, respectively.

Recently, proposed a pattern sewing machine having a simple driving system including a horizontal feed dog driving device which is driven individually and directly by a stepping motor, and capable of accurately controlling the feed operation on the basis of the latest required feed stroke.

By way of example, U.S. Pat. No. 4,286,532 discloses a sewing machine equipped with a feed device which is driven individually. In this sewing machine, the phase of the main shaft of the sewing machine is detected by a main shaft phase detector, the feed shaft is driven in synchronism with the main shaft, and the phase of the feed shaft is regulated on the basis of the main shaft phase detection signal provided by the main shaft phase detector so that the phase of the feed shaft coincides with a predetermined phase to stop the feed motion of the feed shaft at a fixed timing.

Driving the feed device of an electronically controlled pattern sewing machine in synchronism with the reciprocating needle bar by an individual stepping motor or the like, in general, has the following problems adversely affecting the sewing quality.

Since the rotating speed of the main motor for driving the needle bar, hence, the stitching speed, is variable over a wide range according to the stitching condition, the feed stroke for each stitch is variable, namely, the number of driving pulses given to the stepping motor is variable, and the period of the driving pulses is constant, the feed stop timing varies when the feed start timing is fixed; consequently, the feed motion is stopped before the needle thread is tightened by the cooperative effect of the takeup motion of the thread take-up lever and the feed motion, and threby the needle thread is held between the work and the throat plate.

On the other hand, the feed device disclosed in U.S. Pat. No. 4,286,532 is capable of properly controlling the feed stop timing. However, the same feed device needs a main shaft phase detector for detecting the phase of the main shaft, and electrical signaling means for regulating the phase of the feed shaft so that the phase of the feed shaft corresponds to that of the main shaft, which complicates the constitution of the device and increases the manufacturing cost.

SUMMARY OF THE INVENTION

It is an object of the present invention to provide a feed device for a sewing machine, having a feed member which is driven directly by a stepping motor, and capable of properly tightening the needle thread by controlling the operation of the stepping motor according to the operating speed of the main motor of the sewing machine and a predetermined feed stroke.

It is another object of the present invention to provide a feed device not requiring any means for detecting the phase of the main shaft of the sewing machine, having an inexpensive constitution, and capable of properly tightening the needle thread.

A feed device for a sewing machine according to a first invention includes a needle, a main motor driving reciprocatively said needle, speed control means controlling the rotating speed of said main motor, and feed means for feeding a work to be sewn; wherein said feed means comprises, a feed member engageable with said work, a stepping motor driving said feed member directly to impart feed motion to said work, signal generating means generating a feed signal corresponding to the feed stroke of said feed motion in phase with the reciprocation of said needle, and feed control means responsive to said feed signal and the speed signal corresponding to the rotating speed of said main motor for controlling said stepping motor so as to regulate its stop timing to perform at least a portion of said feed motion after completion of tigntening a needle thread.

Said feed control means preferably calculates the period of command pulses to be supplied to said stepping motor in accordance with said feed signal and said speed signal.

Said feed member preferably comprises plural rollers operatively connected with said stepping motor.

Said feed control means is preferably supplied with at least one speed signal every reciprocating cycle of said needle and controls the stop timing of said feed motion in accordance with said feed signal and said supplied speed signal.

Said feed control means is supplied with said speed signal corresponding to a desired speed set by a speed setting device.

A feed device of a sewing machine according to a second invention includes a needle, a main motor driving reciprocatively said needle, a take-up member tightening the needle thread carried by said needle in phase with the reciprocation of said needle, speed control device controlling the rotating speed of said main motor, and feed means for feeding a work to be sewn; wherein said feed means comprises, a feed member engageable with said work, a stepping motor driving said feed member directly to impart feed motion to said work, signal generating means generating a feed signal corresponding to the feed stroke of said feed motion in phase with the reciprocation of said needle, and feed control means controlling said stepping motor by calculating the period of command pulses to be supplied to said stepping motor in accordance with said feed signal and the speed signal corresponding to the rotating speed of said main motor so as to perform at least a portion of said feed motion after completion of tightening said needle thread.

Described hereunder is a function of the feed device according to the first invention.

The needle supporting a needle thread is reciprocatively operated in the vertical direction by the main motor. The operating speed of the main motor is controlled by the speed control means.

In the feed means, when the stepping motor drives the feed member, this feed member puts a work into feed motion. Thus, the work is fed by the feed member driven by the stepping motor.

Since a feed stroke of said feed motion is changed every sewing operation when sewing a stitch pattern, it is necessary for said stepping motor to be controlled in relation to the feed stroke. Furthermore, in order to perform the motion at a predetermined speed, it is further necessary for said stepping motor to be controlled in relation to the operating speed of said main motor.

For that purpose, a feed signal corresponding to the feed stroke of the feed motion with its timing adapted to the reciprocating operation of the needle is generated by signal generating means.

Said feed control means controls a stop timing of the stepping motor in order to perform at least a part of the feed motion after completing the tightening of the needle thread in accordance with said feed signal and a speed signal corresponding to the operating speed of the main motor.

In this step, said feed control means preferably calculates the period of command pulses to be supplied to said stepping motor in accordance said feed signal and said speed signal.

In this connection, either a speed signal corresponding to a desired operating speed set by the speed setting device or a speed signal corresponding to an operating speed detected by the speed detector can be used as said speed signal.

A function of the second invention is almost the same as that of the foregoing first invention, and therefore only difference from the first invention are described hereunder.

A needle thread supported by the needle is tightened every sewing operation by the take-up member with its timing adapted to the reciprocating operation of the needle.

The feed control means controls the stepping motor by calculating the period of command pulses to be supplied to said stepping motor in order to perform at least a part of said feed motion after completing the tightening of the needle thread.

Thus, the driving pulses with their period calculated as described above are supplied to the stepping motor every feed motion, enabling proper setting of the timing for completing the feed motion.

As apparent from the foregoing description, according to the feed device of the first invention, since the feed stepping is so controlled as to perform at least a part of the feed motion after completing the tightening of the needle thread in accordance with the feed signal corresponding to the feed stroke of each feed motion and the speed signal corresponding to the operating speed of the main motor, the needle thread is properly tightened, and the stitching quality is improved.

DESCRIPTION OF THE PREFERRED EMBODIMENT

A preferred embodiment of the present invention will be described hereinafter with reference to the accompanying drawings.

Figure 1:
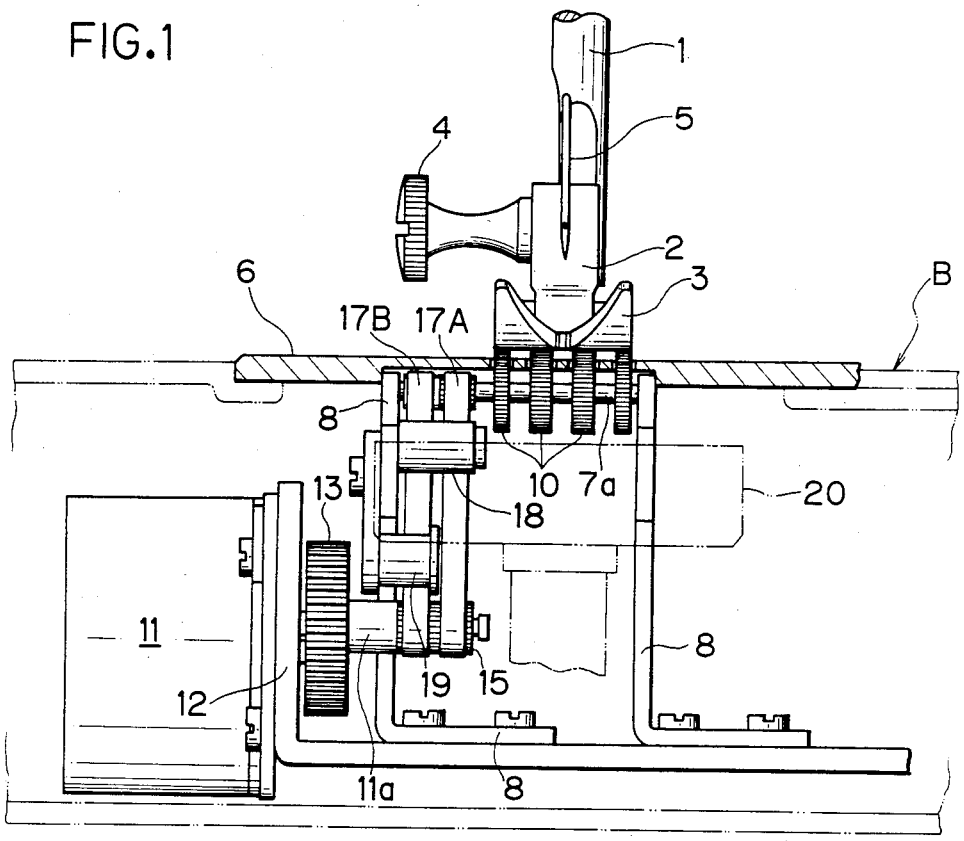
FIG. 1 is a fragmentary sectional front elevation showing a feed device provided within the bed of an electronically controlled pattern sewing machine, and a portion of the sewing machine including a presser foot.
Figure 2:
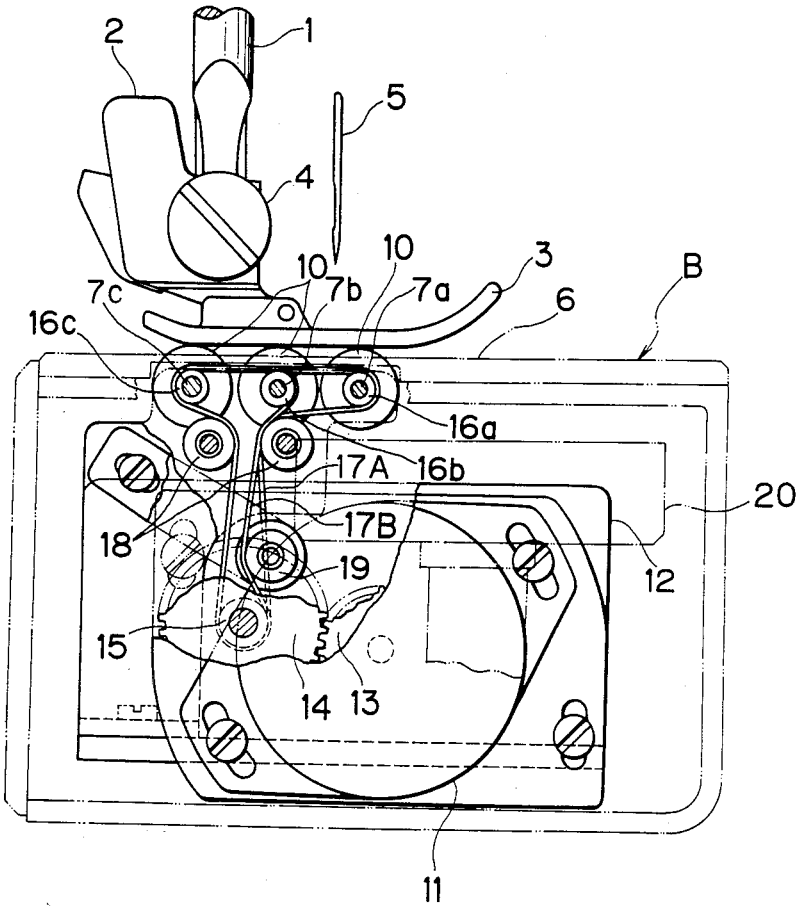
FIG. 2 is a fragmentary sectional side elevation showing the same portion as that shown in FIG. 1.
Figure 3:
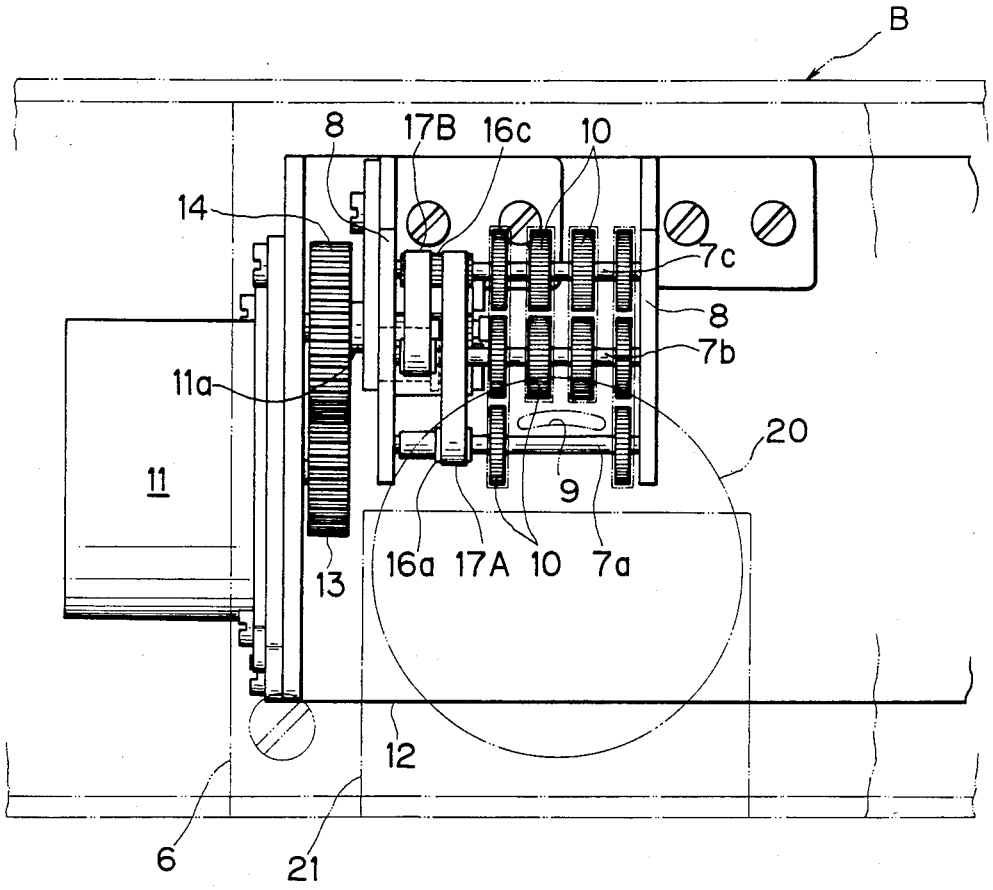
FIG. 3 is a plan view of the feed device shown in FIG. 1.

A feed device embodying the present invention, for an electronically controlled pattern sewing machine feeds a work with feed members directly driven by a stepping motor. The period of command pulses for driving the stepping motor is controlled on the basis of the rotating speed of the main motor of the sewing machine. The needle bar reciprocating mechanism and the thread take-up lever are driven by the main motor, while the feed mechanism having feed rollers partly projecting from the upper surface of the throat plate is driven directly by the stepping motor. Since the needle bar reciprocating mechanism and the thread take-up lever are substantially the same as those of the ordinary electronically controlled pattern sewing machine, the description thereof will be omitted, and the feed device will be described herein with reference to FIGS. 1 to 3.

A presser foot holder 2 is fastened with a screw 4 to the lower end of a presser bar 1 extending downward from the top of the arm of a electronically controlled pattern sewing machine. A presser foot 3 is attached detachably to the presser holder 2. A needle 5 is attached to a needle bar, not shown, extending in front of the presser bar 1.

A roller type feed device having the following constitution is disposed in the bed below the presser bar 1 and the needle bar.

Three parallel shafts *7a*, *7b* and *7c* are disposed at appropriate intervals in the feed direction under a throat plate 6 with their axes perpendicular to the feed direction in a space corresponding to an area somewhat behind the central portion of the throat plate 6 and an area below the presser foot 3 and the left-hand side of the same. The shafts *7a*, *7b* and *7c* each is supported rotatably at the opposite ends thereof on brackets 8 provided inside a bed B.

Under the presser foot 3, a pair of rollers 10 are secured to the front shaft *7a* on opposite sides of a needle slot 9, while four rollers 10 are secured to each of the rear shafts *7b* and *7c*. The rollers 10 protrude slightly from the upper surface of the throat plate 6 through openings formed in the throat plate 6, respectively. A work is held between the presser foot 3 and the rollers 10, and the rollers 10 are rotated to feed the work.

A stepping motor 11 for rotatively driving the shafts *7a*, *7b* and *7c*, hence the rollers 10, to feed the work is attached to a bracket 12 provided in the bed B with the axis of the motor shaft 11*a* in parallel to those of the shafts *7a*, *7b* and *7c*. A driving gear 13 is secured to the motor shaft 11*a*. A driven gear 14 engaging the driving gear 13 is supported rotatably on the brackets 8 and 12. A pulley 15 is secured to the shaft of the driven gear 14, while pulleys 16*a*, 16*b* and 16*c* are secured to the shafts 7*a*, 7*b* and 7*c*, respectively. A timing belt 17A is extended around the pulleys 15, 16*a* and 16*c*, while a timing belt 17B is extended around the pulleys 15, 16*b* and 16*c*. A pair of idle pulleys 18 are provided to guide the timing belts 17A and 17B. A tension pulley 19 is provided to adjust the tension of the timing belt 17B. Thus, the rollers 10 secured to the shafts 7*a*, 7*b* and 7*c*, respectively, are rotated through the timing belts 17A and 17B by the stepping motor 11. The respective circumferences of the rollers 10 are serrated to prevent the slip of the work relative to the rollers 10. Indicated at 20 is a horizontal shuttle race body for accommodating a bobbin, and at 21 is a slide plate.

It is also possible to provide flexible belts of an abrasion-resistant metal or synthetic resin, instead of the rollers 10, in the area where the rollers 10 are disposed, and to drive the flexible belts by the stepping motor 11, or to provide a feed dog of an ordinary sewing machine, and to drive the feed dog for horizontal and vertical movement by the stepping motor 11. Essentially, the feed device is driven directly by the stepping motor 11.

Figure 4:
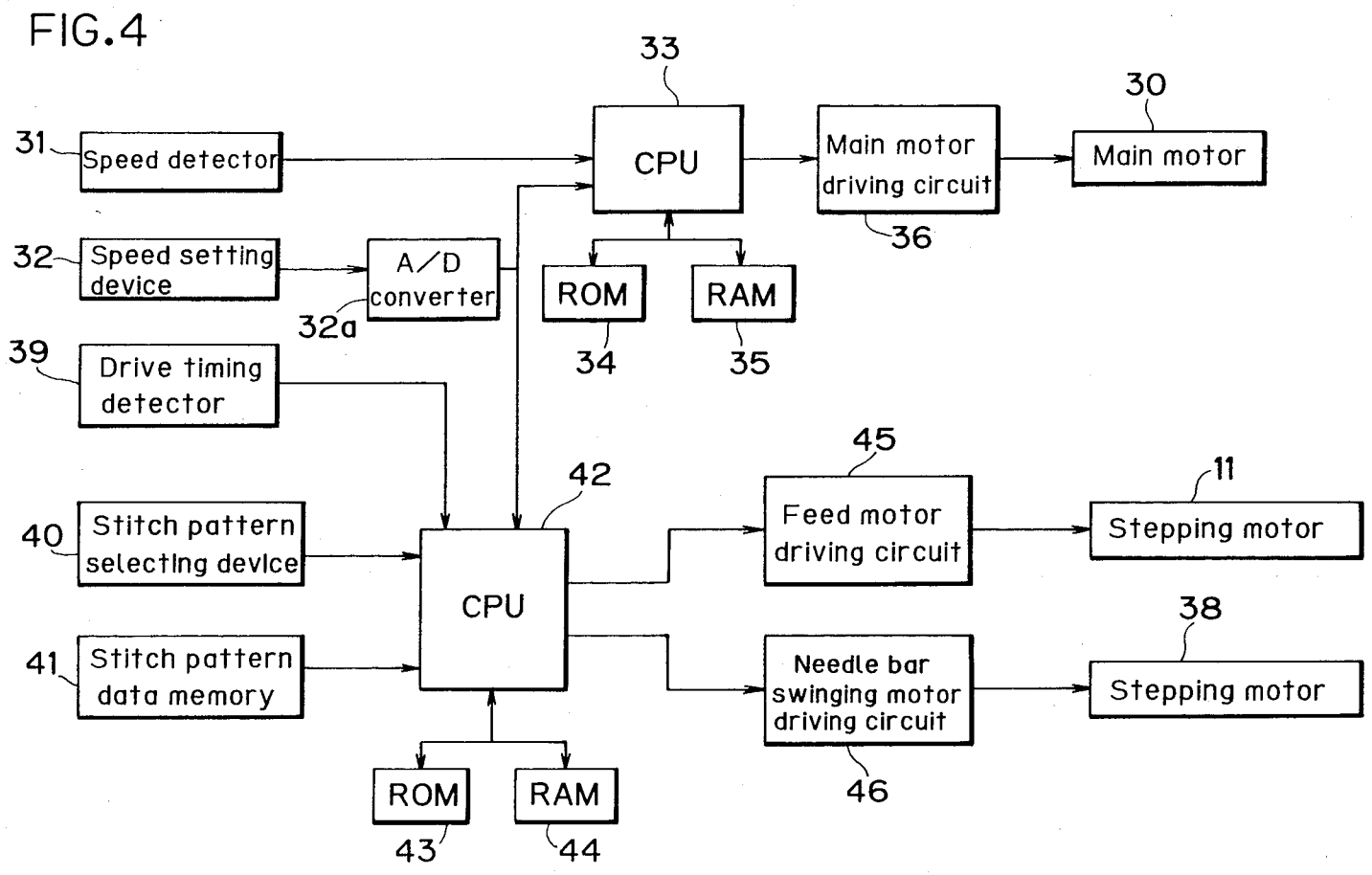
FIG. 4 is a block diagram of a control device incorporated into the electronically controlled pattern sewing machine.

A controller for controlling the main motor of the sewing machine, the stepping motor 11 for driving the feed device, and a stepping motor for swinging the needle bar will be described hereinafter with reference to a block diagram shown in FIG. 4.

A speed control unit for controlling the operating speed of the main motor 30 comprises a speed detector 31, a speed setting device 32, an A/D converter 32*a*, a CPU (central processing unit) 33, a ROM (read only memory) 34, a RAM (random access memory) 35, and a main motor driving circuit 36. The speed control unit carries out feedback control operation so that the operating speed of the main motor 30 coincides with a set speed. The speed detector 31 detects the rotating speed of the output shaft of the main motor 30 or the main shaft of the sewing machine by means of, for example, and electromagnetic sensor. The detection signal of the speed detector 31 is given through an A/D converter, not shown, to the CPU 33. The speed setting device 32 is, for example, a potentiometer, which chooses a rotating speed for the main motor 30 so that the sewing machine is operated at a desired stitching speed. A voltage signal provided by the speed setting device 32 is converted into a corresponding digital signal by the A/D converter 32*a*, and then the digital signal is given to the CPU 33. A control program for controlling the main motor 30 is stored beforehand in the ROM 34. The main motor 30 is controlled according to the control program on the basis of an actual speed signal provided by the speed detector 31 and a set speed signal provided by the speed setting device 32. The CPU 33 operates on the actual speed signal and the set speed signal according to the control program. When necessary, the CPU 33 stores signals read from the ROM 34 or data obtained through operation temporarily in the RAM 35, and gives a control signal for controlling the main motor 30 to the main motor driving circuit 36. The main motor driving circuit 36 supplies a current corresponding to the control signal to the main motor 30.

Thus, during the operation of the sewing machine, the feedback control of the operating speed of the main motor 30 is performed continuously so that the operating speed of the main motor 30 will coincide with the set speed. The mode of this feedback control of the operating speed of the main motor 30 is the same as that for the conventional electronically controlled pattern sewing machine.

A control unit for controlling the stepping motor 11 for driving the feed device and the stepping motor 38 for swinging the needle bar comprises the speed setting device 32, the A/D converter 32*a*, a drive timing detector 39, a stitch pattern selecting device 40, a stitch pattern data memory 41, a CPU (central processing unit) 42, a ROM (read only memory) 43, a RAM (random access memory) 44, a feed motor driving circuit 45, and a needle bar swinging motor driving circuit 46.

The drive timing detector 39 includes a limit switch or a photo-interrupter for detecting the arrival of the needle bar at the uppermost position every stroke of the needle bar. The drive timing detector 39 gives a drive timing signal to the CPU 42.

The stitch pattern data memory 41 stores the data of the magnitude of feed stroke and the magnitude of the swing of needle bar swing (needle swing) for each stitch pattern in a group of addresses. The stitch pattern selecting device 40 selects a stitch pattern stored in the stitch pattern data memory 41 by using a code number, and then gives a pattern selection signal to the CPU 42. The ROM 43 stores a control program for controlling the stepping motor 11 for driving the feed device, and the stepping motor 38 for swinging the needle bar. Thus stitch pattern data memory 41 and control program ROM 43 form a signal generator. Upon the reception of the stitch pattern selection signal, the CPU 42 reads the stitch pattern data sequentially from the stitch pattern data memory 41 and, when required, stores the data and the signals temporarily in the RAM 44. The CPU 42 gives a series of control signals at predetermined timings determined by the drive timing signals, respectively, to the feed motor driving circuit 45 and to the needle bar swinging motor driving circuit 46. Then, the feed motor driving circuit 45 and the needle bar swinging motor driving circuit 46 give a series of driving pulses corresponding to a series of the control signals to the stepping motor 11 for driving the feed device and to the stepping motor 38 for swinging the needle bar, respectively, whereby a stitch pattern selected by the stitch pattern selecting device 40 is stitched.

Among a series of the control operations for stitching the stitch pattern, those other than the feed control operations are the same as the control operations of the conventional electronically controlled pattern sewing machine.

In order to fix the feed start timing and the feed stop timing by controlling the period of driving pulses to be applied to the stepping motor 11 for driving the feed device according to the operating speed of the main motor 30 and the magnitude of feed, the following feed control operation is executed.

Figure 5:
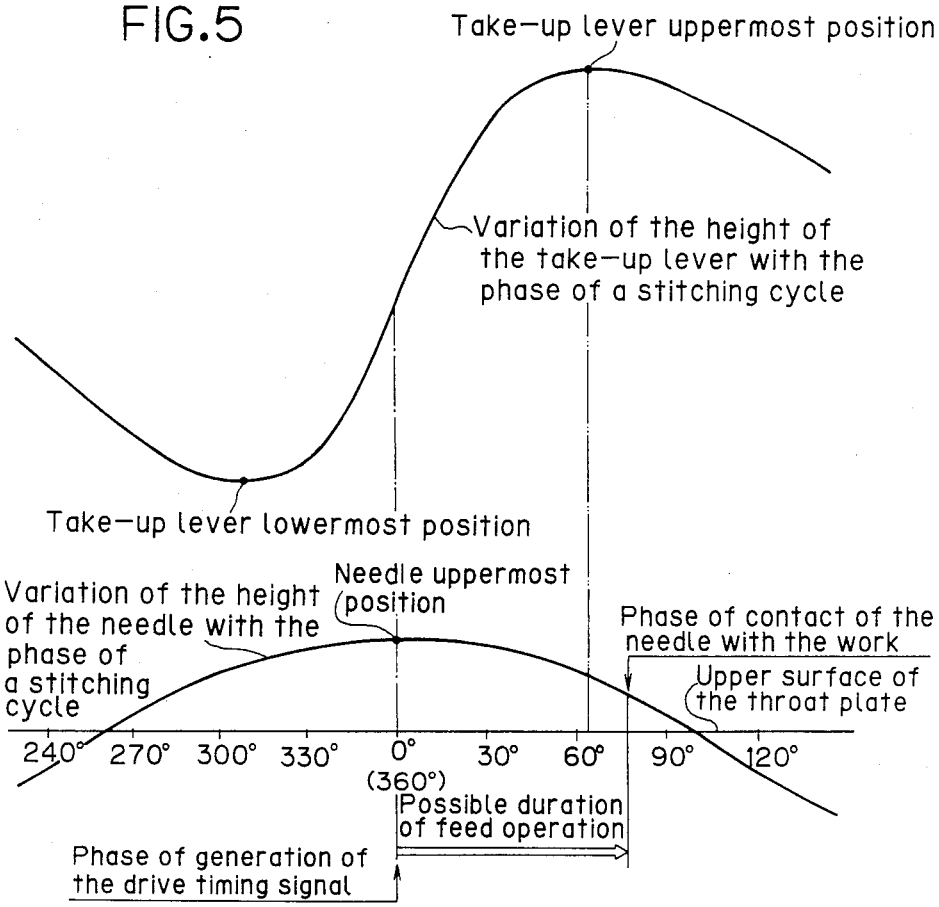
FIG. 5 is a diagram showing curves indicating the variation of the vertical position of the thread take-up lever and that of the needle with the phase of the main shaft.

Referring to FIG. 5 showing the plot of the vertical position of the needle 5 vs. the phase of stitching cycle, and the plot of the vertical position of the take-up lever which operates in phase with the needle 5 vs. the phase of stitching cycle, it is desirable to start the feed operation after the needle 5 has arrived at the uppermost position, while the feed operation must be completed before the needle 5 is thrusted into the work. Furthermore, it is most desirable to start the feed operation after the needle thread has been tightened sufficiently by the take-up lever. However, since the interval between a time when the take-up lever arrives at the uppermost position and a time when the needle meets the work is comparatively small, particularly, when the operating speed of the main motor 30 is high, it is difficult to complete the feed operation during such an interval. Accordingly, the feed operation is carried out between a time when the needle arrives at the uppermost position and a time when the needle meets the work. In order to carry out the feed operation in such a mode, a feed start timing is determined by a drive timing signal, while the take-up lever is driven by the main motor 30 in phase with the vertical motion of the needle 5. Accordingly, the timing of coincidence of the needle 5 with the work is calculated on the bases of the operating speed of the main motor 30 and the drive timing signal according to a predetermined control program.

A feed control routine will be described hereinafter with reference to flow charts shown in FIGS. 8 and 9. A feed control program defining the feed control routine is stored beforehand in the ROM 43.

Figure 8:
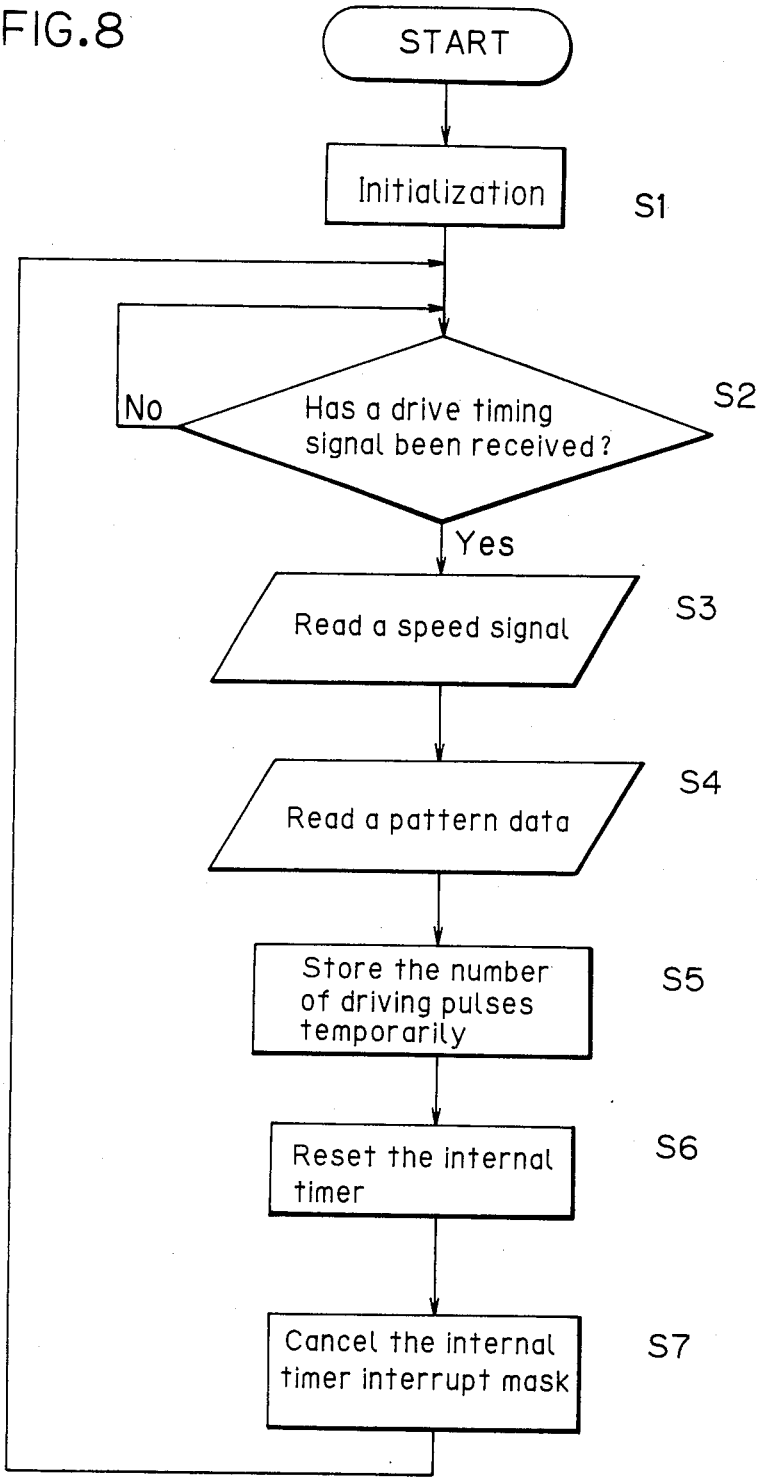
FIGS. 8 and 9 are flow chart showing a control routine for feed control operation.

Referring to FIG. 8, upon the start of the sewing operation, the CPU 42 starts the control operation. At step S1, the controller is initialized. At step S2, a decision is made as to whether or not a drive timing signal from the drive timing detector 39 has been given to the CPU 42. When the decision at step S2 is NO, the step S2 is repeated, and when the decision is YES, the routine advances to step S3. At step S3, a speed signal indicating a set operating speed of the main motor 30 is read from the speed setting device 32. At step S4, the pattern data defining respective stitching actions for stitching a stitch pattern corresponding to a pattern selection signal is read from the stitch pattern data memory 41. At step S5, the number of driving pulses for feeding the work, which is included in the pattern data, is stored temporarily in the RAM 44. At step S6, the internal timer of the CPU 42 is reset, and then an internal timer interrupt control routine shown in FIG. 9 is started.

In the internal timer interrupt control routine, at step S10, a feed time is calculated on the basis of the speed signal, and then the period of the driving pulses is calculated on the basis of the feed time and the number of the driving pulses. At step S11, the internal timer is set for the period of the driving pulses, and the internal timer gives a trigger signal for every period of the driving pulses. At step S12, in synchronism with the trigger signal given by the internal timer, the CPU gives a feed control signal to the feed motor driving circuit 45, so that the stepping motor 11 is driven by one step. At step S13, a decision is made as to whether or not the stepping motor 11 has been moved by steps corresponding to the number of driving pulses. When the decision at step S13 is NO, the routine returns to step S12. When the decision at step S13 is YES, namely, when the work is fed by a necessary distance and is prepared for the next stitching operation, the internal timer interrupt control routine is masked at step S14 to end the internal timer interrupt control routine, and then the control operation returns to the main control routine shown in FIG. 8. Then, at step S7, the internal timer interrupt mask is cancelled for the next internal timer interruption, and then the routine returns to step S2 to repeat the same control routine.

Figure 6:
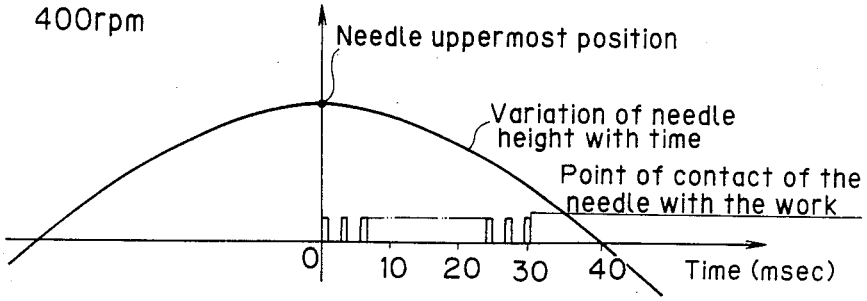
FIGS. 6 and 7 are diagrams showing a curve indicating the variation of the height of the needle with time during the low-speed stitching operation of the needle, and a curve indicating the variation of the height of the needle with time during the high-speed stitching operation of the needle, respectively, in relation to the mode of pulse signal.
Figure 7:
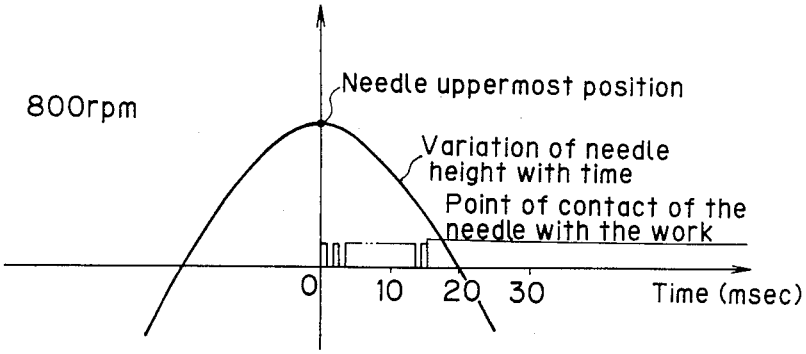

Thus, the CPU 42 determines the period of driving pulses on the basis of the speed signal and the number of the driving pulses corresponding to the pattern data every reception of the drive timing signal. Then, driving pulses are applied sequentially at the period thus determined to the stepping motor 11 to feed the work. By way of example, different modes of the driving pulses are shown in relation to the vertical movement of the needle in FIGS. 6 and 7. In FIGS. 6 and 7, the operating speed of the main motor 30 is 400 rpm and 800 rpm, respectively. When the number of the driving pulses is fixed regardless of the operating speed of the main motor 30, the period of the driving pulses is long when the operating speed of the main motor 30 is low as shown in FIG. 6, and the period is short when the operating speed of the main motor 30 is high as shown in FIG. 7, so that the feed start timing and the feed stop timing are fixed.

Although, in the foregoing embodiment, the period of the driving pulses is determined on the basis of the set speed signal for setting the operating speed of the main motor 30, given by the speed setting device 32 to the CPU 42, it is also possible to determine the period of the driving pulses on the basis of a speed signal indicating the actual operating speed of the main motor 30, given by the speed detector 31 to the CPU 42.

Figure 9:
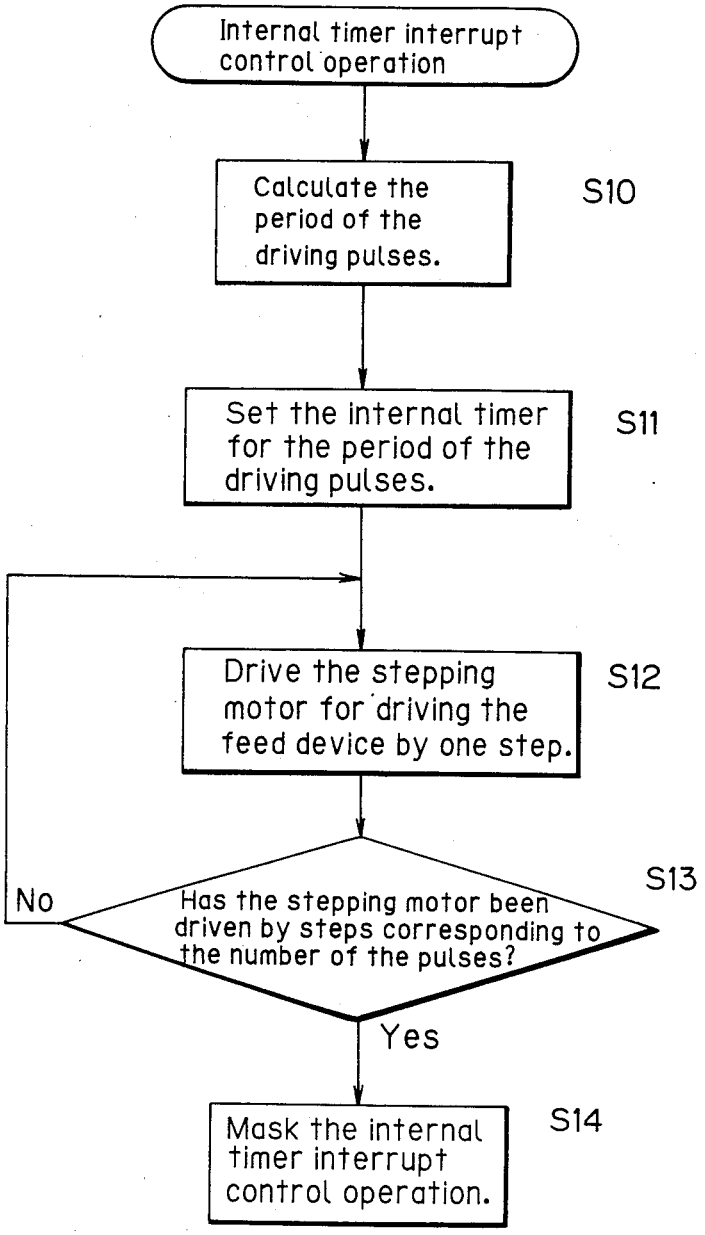

Furthermore, the interrupt control routine shown in FIG. 9 may be incorporated into the control routine shown in FIG. 8.

What is claimed is:

1. A feed device for a sewing machine including a needle, a main motor driving reciprocatively said needle, speed control means controlling the rotating pseed of said main motor, and feed means for feeding a work to be sewn; wherein said feed means comprises, a feed member engageable with said work, a stepping motor driving said feed member directly to impart feed motion to said work, signal generating means generating a feed signal corresponding to the magnitude of the feed stroke of said feed motion in phase with the reciprocation of said needle, a detecting means for detecting a drive timing corresponding to a predetermined phase of said needle, and feed control means responsive to said feed signal and a speed signal corresponding to the rotating speed of said main motor for controlling the period of command pulses to be supplied to said stepping motor so that said feed motion may be carried out between said drive timing and a given timing just before said needle contacts said work.

2. A feed device for a sewing machine according to claim 1, wherein said feed control means calculates the period of command pulses to be supplied to said stepping motor in accordance with said feed signal and said speed signal.

3. A feed device for a sewing machine according to claim 1, wherein said feed member comprises plural rollers operatively connected with said stepping motor.

4. A feed device for a sewing machine according to claim 1, wherein said feed control means is supplied with at least one speed signal every reciprocating cycle of said needle and controls the stop timing of said feed motion in accordance with said feed signal and said supplied speed signal.

5. A feed device for a sewing machine according to claim 1, wherein said feed control means is supplied with said speed signal corresponding to a desired speed set by a speed setting device.

6. A feed device for a sewing machine including a needle, a main motor driving reciprocatively said needle, a take-up member tightening the needle thread carried by said needle in phase with the reciprocation of said needle, speed control device controlling the rotating speed of said main motor, and feed means for feeding a work to be sewn; wherein said feed means comprises, a feed member engageable with said work, a stepping motor driving said feed member directly to impart feed motion to said work, signal generating means generating a feed signal corresponding to the magnitude of the feed stroke of said feed motion in phase with the reciprocation of said needle, a detecting means for detecting a drive timing corresponding to a predetermined phase of said needle, and feed control means controlling said stepping motor by calculating the period of command pulses to be supplied to said stepping motor in accordance with said feed signal and a speed signal corresponding to the rotating speed of said main motor for controlling the period of command pulses to be supplied to said stepping motor so that said feed motion may be carried out between said drive timing and a given timing just before said needle contacts said work.

7. A feed device according to claim 1, wherein said detecting means detects a timing signal corresponding to the uppermost position of said needle.

8. A feed device according to claim 1, including a take-up lever for tightening sewing thread in said needle and means for controlling said take-up lever to tighten said thread during a portion of said feed motion.

9. A feed device for a sewing machine including a needle, a main motor driving reciprocatively said needle, a take-up member tightening the needle thread carried by said needle in phase with the reciprocation of said needle, speed control means controlling the rotating speed of said main motor, and feed means for feeding a work to be sewn; wherein said feed means comprises, a feed member engageable with said work, a stepping motor for driving said feed member directly to impart feed motion to said work, a memory means for storing a feed signal representative of the magnitude of the feed stroke of said feed motion and for generating the feed signal in phase with the reciprocation of said needle, a detecting means for detecting a drive timing corresponding to a predetermined phase of said needle, a speed signal generating means for outputting a speed signal corresponding to the rotating speed of said main motor, and a feed control means for calculating the period of command pulses on basis of said speed signal and said feed signal and for supplying said command pulses to said stepping motor, said feed control means being adapted to control the duration of supplying said command pulses so that said feed motion may be carried out between said drive timing and a given timing just before said needle contacts said work.

10. A feed device for a sewing machine according to claim 9, wherein said feed member comprises plural rollers operatively connected with said stepping motor.

11. A feed device for a sewing machine according to claim 9, wherein said feed control means is supplied with at least one speed signal every reciprocating cycle of said needle.

12. A feed device for a sewing machine according to claim 9, wherein said feed control means is supplied with said speed signal corresponding to a desired speed set by a speed setting device.

* * * * *